United States Patent [19]

Hoffmann et al.

[11] Patent Number: 4,471,487

[45] Date of Patent: Sep. 11, 1984

[54] SLEWING TOWER FOR LADLES

[76] Inventors: Rudolf Hoffmann, Heyenfeldweg 50a, Krefeld, Fed. Rep. of Germany, 4150; Adolf G. Zajber, OpladenerStrasse 181, Langenfeld, Fed. Rep. of Germany, 4018; Herbert Hansen, Am Wagenrast 10, Düsseldorf, Fed. Rep. of Germany, 4000 12; Johannes Drüppel, Braunschweigerstr. 49, Oberhausen, Fed. Rep. of Germany, 420011

[21] Appl. No.: 313,761

[22] Filed: Oct. 22, 1981

[30] Foreign Application Priority Data

Oct. 15, 1981 [DE] Fed. Rep. of Germany ..... 3038876

[51] Int. Cl.[3] ..... H05B 7/00

[52] U.S. Cl. ..... 373/78; 373/43; 373/98; 373/83; 222/593

[58] Field of Search ..... 222/591, 592, 593, 594, 222/602, 604, 606, 607; 373/78, 98, 83, 84, 105, 43, 45, 52, 53

[56] References Cited

U.S. PATENT DOCUMENTS

| | | | |
|---|---|---|---|
| 1,318,164 | 10/1919 | McConnell | 373/43 X |
| 3,894,576 | 7/1975 | Schoffmann | 222/607 X |
| 4,286,738 | 9/1981 | Blum | 222/607 X |

*Primary Examiner*—Roy N. Envall, Jr.

*Attorney, Agent, or Firm*—Schwartz, Jeffery, Schwaab, Mack, Blumenthal & Koch

[57] ABSTRACT

To avoid loss of temperature of a melt contained in casting ladles in a continuous casting operation, an independently rotatable platform adapted to receive a heating device is disposed on a slewing column of a slewing tower for ladles. The heating device is similar to that of an arc melting furnace and comprises a vertically adjustable electrode holder of outrigger configuration whose guide column is arranged eccentrically on the platform so that a current carrying cable can be installed to extend centrally through the platform and through the slewing column. The cables are secured by a clamping plate at a perpendicular distance from the platform, such that the electrode holder, as seen from the casting position, can pivot in both pivoting directions through approximately 180°, without the cable tearing as a result of twisting.

8 Claims, 1 Drawing Figure

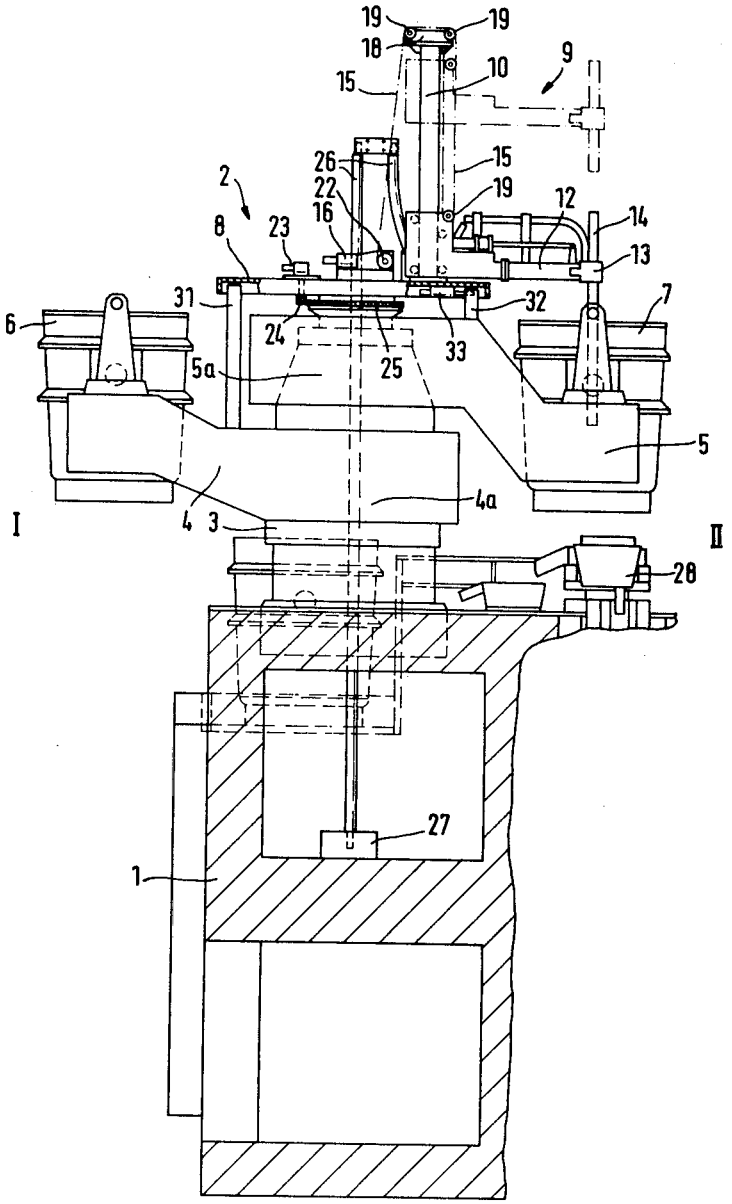
19
19
18
10
9
15
15
26
22
16
19
12
14
2
8
23
13
31
32
7
6
24
33
5a
25
5
4a
I
4
3
II
28
27
1

SLEWING TOWER FOR LADLES

The present invention relates to a slewing tower for ladles in a continuous casting plant with a stationary slewing column and two pivotable support arms adapted to receive casting ladles.

The use of a so-called slewing tower for ladles is known for the purpose of providing a continuous supply of molten metal to a continuous casting plant. Conventionally, the slewing tower for ladles is constructed so that it is either provided with a contiguous rigid support arm with receptor means for one casting ladle at the end of each arm (German Patent Specification No. 1 220 562) or two support arms, able to pivot independently of each other, are provided for each casting ladle (German Patent Specification No. 1 608 094) and the support arms are disposed in superjacent configuration on the common slewing column.

Irrespective of the particular construction of the device for making ready the casting ladles, it must be assumed that the liquid steel in the casting ladle—more especially if small quantities are involved—suffers detrimental temperature losses which occur initially when the molten metal is transported from the converter of the steel making shed to the slewing tower for the ladles. The liquid steel suffers a further loss of temperature during the actual casting operation which can sometimes require up to 60 minutes. Excessive temperature losses lead to premature skulling in the ladle, preventing perfect continuous casting, particularly when a relatively small ladle content is casted over the longest possible casting period, as may be required by the low casting speeds dictated by relatively small strand dimensions and a small number of strands.

In order to counteract such temperature losses or to maintain them within tolerable limits, it has been the practice to use heated ladles with a substantially superheated melt. This naturally calls for correspondingly increased converter temperatures. Furthermore, to reduce the radiation losses, large quantities of anti-pipe compound must be spread on to the ladle slag.

It is an object of the present invention to provide a device for a slewing tower for casting ladles, whereby the temperature losses of the melt which occur during transportation of a casting ladle which is suspended from the support arm of a slewing tower, are compensated and the melt can be maintained for a prolonged period within a temperature range which is substantially constant.

According to the invention, this problem is solved by a provision on the slewing column of the slewing tower of a platform for ladles, which is rotatable relative to the slewing column, and is provided with a heating device. In one embodiment of the invention the heating device comprises a perpendicular guide pillar to guide a vertically adjustable outrigger with clamping devices for at least two electrodes. The electrodes are designed to be lowered into the interior of the casting ladle, and current-carrying cables for the electrodes are installed via the outrigger and pass freely through the rotatable platform and into the interior of the slewing column to a clamping plate, situated at a distance from the platform, |—| such that twisting of the cable permits pivoting of the outrigger or of the electrodes in both pivoting directions through approximately 180°—as seen from the electrode pivoting position associated with the casting position. As a rule, the electrodes are submerged into the melt after the casting ladle is in the desired operating position. Provision is preferably made for pivoting the casting ladle with great rapidity from the casting position over an emergency vessel, in the event of a malfunction, which may necessitate interruption of the casting operation; for example, in the event of strand breakage or damage to the plug or valve means. To enable the lowered electrode system to execute such motion without suffering damage, since the outrigger with the electrode cannot be moved as rapidly as necessary in the event of an emergency, the current carrying cables are disposed to permit corresponding twisting, which means that the entire device can be pivoted through nearly 360°. This pivotability also makes it possible, where appropriate, for the electrodes in their inoperative position, to plunge into the casting |—| ladle which has just been taken over by the support arm. The melt can therefore be heated while it is still being pivoted into the operating position.

In another preferred embodiment of the invention, the eccentric position of the guide pillar ensures that the cables can be guided centrally through the platform and through the slewing column of the slewing tower as far as the cable clamping plate.

The invention also provides that the slewing drive for the platform comprises an electric motor supported by the platform and having a pinion which meshes with a gear rim secured on the slewing column.

Preferably, locking means are provided so that in an emergency, when the platform and the casting ladle support arm are required to traverse jointly, a signal from the control pulpit of the plant causes a bolt or key, operated by means of a hydraulic cylinder, to establish a connection between the platform and the hub of the appropriate support arm so that synchronism is obtained during the pivoting motion and the platform with the outrigger is entrained by the support arm for the casting ladles. It is also within the scope of the invention to provide for electrical synchronism (identical angular velocities) between support arms and platforms in place of mechanical interlocking.

One exemplified embodiment of the invention is illustrated in the accompanying drawing and explained hereinbelow. The single FIGURE of the drawing shows a view of a slewing tower for ladles, anchored on a foundation, having two support arms which are independently supported by the slewing column and which are provided with the heating device according to the invention.

The exemplified embodiment shows the foundation 1 for a slewing tower for ladles, referenced in its entirety with the numeral 2 and associated with a continuous casting plant, not shown. The ladle slewing tower 2 is provided with a central slewing column 3 on which the two independently pivotable support arms 4, 5 are disposed by means of hubs *4a*, *5a*. Each support arm 4, 5 is constructed in bifurcated configuration and is adapted to receive one casting ladle 6 or 7.

A rotatable platform 8 is disposed on the slewing column 3 of the slewing tower 2. The platform 8 is provided with a heating device, referenced with the numeral 9, and a guide pillar 10, for a rise-and-fall outrigger 12, which is provided eccentrically on the platform 8. Clamping devices 13 of the outrigger 12 retain electrodes 14, which are lowered into the casting ladle, in its casting position, to heat up or maintain the heat of the melt. Raising and lowering of the outrigger 12 is effected by the rope connection 15 between the outrigger 12 and a drive motor 16. One end of the rope 15 is fixedly connected to an apron 18 of the guide pillar 9. From there, the rope 15 is guided via reversing pulleys 19 of the outrigger 12 or of the apron 16 to a coiling roller 22 of the motor 16 which is also secured on the platform 8. Furthermore, the rotary drive for the platform itself is also mounted on the platform. The rotary drive comprises an electric motor 23 whose pinion 24 meshes with a gear rim 25, secured on the slewing column 3 of the ladle slewing tower 2. Current-carrying cables 26 are installed over the outrigger 12 through the platform 8 and the interior of the slewing column 3 to a clamping plate or terminal plate 27 to supply current to the electrodes 14. The distance from the cable terminal point must be selected so that twisting of the current carrying cables 26 permits pivoting through approximately 180°, since the platform 8 together with the outrigger 12 must traverse through a pivoting distance of approximately 180° in the event of emergency travel of a casting ladle support arm 4, 5.

In the illustrated situation, the support arm 4 in its inoperative position I has just taken over a freshly filled casting ladle 6 from a shed crane. The contents of the casting ladle 7 in the casting position II have almost been poured, which can be recognized by the completely lowered position of the outrigger 12. Furthermore, it is not only the diminishing ladle content which calls for constant lowering of the electrodes but wear of the electrodes due to burning is also compensated in this manner. To change the casting ladles the outrigger 12 with the electrodes 14 must first traverse out of the casting ladle into the position shown in dash-dot lines where the electrodes are situated above the casting ladle. The empty casting ladle is then exchanged for the filled casting ladle and to this end the support arms 4, 5 perform a rotating motion about the slewing column 3. During the changeover time the continuous casting plant is supplied with melt from the contents of the intermediate vessel 28. When the inoperative position I is reached, the emptied ladle is transported away by the shed crane and the support arm is free to receive a freshly filled casting ladle. In the casting position II the electrodes 14 are simultaneously immersed into the filled casting ladle to heat up and maintain the heat of the melt and top-up feeding of the intermediate vessel 28 for continuous casting is continued.

The above-described proper changeover of the casting ladles cannot be performed if emergency travel of the ladle, in the course of casting in position II, becomes necessary in the event of malfunctioning. In such an event, insufficient time is operable to move the electrodes 14 out of the casting ladle prior to pivoting the support arm. It is therefore essential to ensure that in the event of emergency travel of the support arms 4 or 5, the platform 8 together with the structures associated with the heating device are pivoted in synchronism with the support arm.

To achieve synchronism, the support arms 4, 5 are provided with fixed brackets 31 or 32 for mechanical interlocking according to the exemplified embodiment. In the casting position II, a cylinder 33 is mounted on the platform 8 and is operable to insert a locking device, for example a bolt or key, into a groove, not shown, of the bracket 31 or 32 in order to connect the platform 8 to the support arm 4 or 5. It is advantageous that such interlocking is performed as a matter of course in the casting position for the duration of the casting operation.

What is claimed is:

1. A slewing tower for casting ladles filled with molten metal, comprising:

a stationary slewing column;

at least one support arm pivotally mounted on said column and adapted to receive a casting ladle and pivot it to a casting position;

a platform rotatably mounted on said column above said support arm;

drive means for rotating said platform with respect to said column;

a heating means disposed eccentrically on said platform and operable for heating molten metal in a casting ladle received by said support arm;

flexible conduits for supplying energy to said heating device, said conduits extending from said heating means freely through said platform and said column to thereby enable twisting of said conduits during rotation of said platform and said eccentrically disposed heating means.

2. A slewing tower according to claim 1, further including a clamping plate, said flexible conduits being connected to said clamping plate which is disposed a distance from said platform, such that twisting of said conduits permits pivoting of said heating means in either direction with respect to the casting position, through approximately 180° of rotation.

3. The slewing tower according to claim 1, wherein said heating means comprises a perpendicular guide pillar and a vertically adjustable outrigger guided by said guide pillar, said outrigger having clamping means for clamping at least two electrodes which are operable to be lowered into a casting ladle, said flexible conduits comprising current carrying cables which pass over said outrigger and freely through said rotatable platform and into said slewing column to a clamping plate which is disposed at a distance from said platform whereby said cables are free to twist to thereby permit pivoting of said outrigger in either direction, with respect to the casting position, through approximately 180° of rotation.

4. The slewing tower according to claim 1, further comprising two independently pivotable support arms having hubs disposed in a superjacent configuration.

5. The slewing tower according to claim 4, further including locking means for locking the position of said hubs with respect to said rotatable platform.

6. A slewing tower for ladles as claimed in claim 3, wherein the guide pillar is disposed eccentrically on the platform and the cables extend centrally through the platform.

7. A slewing tower for ladles as claimed in claim 1, wherein the slewing drive for the platform comprises an electric motor, supported by the platform, and having a pinion adapted to mesh with a gear ring secured on the slewing column.

8. A slewing tower for ladles as claimed in claim 1, including means for locking said platform to said support arm supporting said casting ladle in the casing position.

* * * * *

UNITED STATES PATENT AND TRADEMARK OFFICE

CERTIFICATE OF CORRECTION

PATENT NO. : 4,471,487

DATED : September 11, 1984

INVENTOR(S) : Hoffmann et al.

It is certified that error appears in the above—identified patent and that said Letters Patent is hereby corrected as shown below:

On the cover sheet of the Patent, in addition to the inventors listed, the following inventors should be added:

Klaus Bick
Helmershauser Weg 4, 4790 Paderborn
Federal Republic of Germany

Friedhelm Vennmann
Birkenstr. 28, 4450 Lingen 1
Federal Republic of Germany

Lothar Harmsen
Zedernweg 16, 4450 Lingen 1
Federal Republic of Germany

Gerd Schweers
Bernhard Sinne Str. 14, 4790 Paderborn
Federal Republic of Germany Signed and Sealed this

*Twenty-sixth* Day of *March 1985*

[SEAL]

*Attest:*

DONALD J. QUIGG

*Attesting Officer* *Acting Commissioner of Patents and Trademarks*